United States Patent [19]

Sullivan, Jr.

[11] Patent Number: 4,892,597

[45] Date of Patent: Jan. 9, 1990

[54] DISSOLVED TRINITROTOLUENE IN SENSITIZED NITROMETHANE

[75] Inventor: John D. Sullivan, Jr., Edgewood, Md.

[73] Assignee: The United States of America as represented by the Secretary of the Army, Washington, D.C.

[21] Appl. No.: 401,194

[22] Filed: Aug. 30, 1989

[51] Int. Cl.[4] ..... C06B 25/38

[52] U.S. Cl. ..... 149/91; 149/105

[58] Field of Search ..... 149/91, 105

[56] References Cited

U.S. PATENT DOCUMENTS

| | | | |
|---|---|---|---|
| 2,338,120 | 1/1944 | Lawrence | 149/48 |
| 2,690,964 | 10/1954 | Maisner | 149/91 |
| 3,288,867 | 11/1966 | Egly et al. | 568/925 |
| 3,309,251 | 3/1967 | Audrieth | 149/89 |
| 3,663,324 | 5/1972 | Roberts | 149/90 |
| 3,747,679 | 7/1973 | Roberts | 166/299 |
| 3,798,092 | 3/1974 | Runge et al. | 149/89 |
| 3,954,532 | 5/1976 | Kompolthy et al. | 149/105 |
| 3,956,040 | 5/1976 | Tezuka | 149/46 |

*Primary Examiner*—Stephen J. Lechert, Jr.

*Attorney, Agent, or Firm*—Saul Elbaum; Freda L. Krosnick

[57] ABSTRACT

A liquid explosive composition having a density of about 1.282 grams/milliliter and comprising a mixture of (a) nitromethane, (b) trinitrotoluene, and (c) pyridine. Said ingredients being present in a weight ratio of about 60–64 parts nitromethane; 34–29.5 parts trinitrotoluene; and 6–6.5 parts pyridine.

10 Claims, No Drawings

DISSOLVED TRINITROTOLUENE IN SENSITIZED NITROMETHANE

RIGHTS OF THE GOVERNMENT

The invention described herein may be manufactured, used and licensed by or for the U.S. Government without payment to me of any royalty thereon.

BACKGROUND OF THE INVENTION

The number of liquid explosives are relatively few when compared to the number of solid explosives presently available. Moreover, among those few liquid explosives, most of them are not used in industry. As a matter of fact, their uses are limited to that of laboratory experimentation.

This invention relates to a new liquid explosive composition which is freely pourable and hence conforms to any shape any provides good blast coupling. Said invention has commercial use and is created from easily obtainable explosives and materials, such as, nitromethane, trinitrotoluene and pyridine. The liquid explosive of the present invention may be used in shaped charges, reactive armors, bombs and warheads.

Nitromethane, which acts as the base of the present invention, was first synthesized by Kolbe in 1872. It is so insensitive that it was not until 1938 that its detonation property was revealed by McKittrick. Once this detonation property was discovered, research was initiated to find sensitizers to increase its ease of detonation. World War II research produced sensitizers, primarily amines, which made nitromethane detonatable with a blasting cap. In 1945, Ericksen and Rowen listed over one dozen nitromethane - amine mixtures along with their explosive ability. These nitromethane - amine mixtures are set forth in U.S. Pst. No. 3,309,251 (Audrieth, Ericksen and Tomlinson) at column 1, line 56 through column 2, line 6.

U.S. Pat. No. 3,798,092 issued to Runge and Edwards teaches a liquid explosive having a low freezing point. Said liquid explosive comprises nitromethane and methylene chloride in the weight ratio of 70 to 30, respectively. The explosive is sensitized by 2–12% by weight of diethylenetriamine (DETA). The presence of DETA in said liquid explosive is critical.

U.S. Pat. Nos. 3,663,324 and 3,747,679, both issued to Roberts, teach a liquid explosive in suspension form which comprises 20 parts by weight of a high explosive in nitromethane. The references, however, do not teach the addition of a high explosive, such as trinitrotoluene, in an amine-sensitized nitromethane. They further do not teach the high explosive and nitromethane combination in the form of a true solution. Moreover, the explosives of Roberts involve at least five components; whereas, the present invention comprises a three-component explosive solution.

U.S. Pat. No. 3,288,867, issued to Egly and Jeffries, teaches the addition of acetone, methylene chloride and numerous other ingredients, other than those claimed herein, to nitromethane. These ingredients are added to nitromethane in order to prevent its detonation. The reference teaches these, and other solvents, as desensitizers; and hence, this reference teaches away from the present invention.

Nitromethane, in the amount of 15–40% by weight, has been added to ammonium nitrate to form slurries.

These mixtures do not have consistent detonation velocity and they are not in liquid form.

Nitromethane is further known to reduce the sensitivity of nitroglycerine. Note, for example, the teachings of Lawrence in U.S. Pat. No. 2,338,120. This reference teaches that nitromethane may be added to compositions containing nitroglycerine. The reference further teaches that trinitrotoluene may be added to said compositions. What this reference fails to teach is explosive compositions without the presence of nitroglycerine. It further fails to teach the use of pyridine in said explosives.

Pyridine is known to be a highly effective solvent for trinitrotoluene. It is also a well-known sensitizer for nitromethane; however, it is seldom used for its sensitizer properties because more effective sensitizers are known and available.

Trinitrotoluene was found to be soluble in nitromethane. The U.S. Army Ballistic Research Laboratory was not aware of this property until 1987.

Although the individual components of the present invention (nitromethane, trinitrotoluene, and pyridine) are all well-known chemicals which have been used for one purpose or another, prior to this invention, these three components had never been combined to form a liquid explosive.

BRIEF SUMMARY OF INVENTION

This invention consists of a liquid explosive composition which may be used, for example, in shaped charges, reactive armors, bombs and warheads. Said liquid explosive comprises (a) nitromethane, (b) trinitrotoluene (TNT), and (c) pyridine. Said ingredients have a weight ratio of (a):(b):(c) of about 60–64:34–29.5:6–6.5. Moreover, the liquid explosive has a density of about 1.282 grams/milliliter. When dealing with liquid explosives, the higher the density of said explosive, the greater its detonation energy.

Among the advantages of using a liquid explosive, and in particular, the liquid explosive of the present invention are as follows:

1. A liquid explosive is freely pourable and therefore conforms to any shape or form for use.
2. New warhead geometries may be tested more easily since machined molds and casting facilities are not used by the present invention.
3. The composition herein is denser than nitromethane alone; and therefore, puts more explosive weight in a small volume.
4. Elaborate mixing techniques are not needed or used in this invention.
5. The composition of the present invention does not separate upon 24-hours of standing as do other explosives.
6. The sensitizer (pyridine) can be kept separate from the trinitrotoluene and nitromethane combination; and it can be added just before the use of the explosive. This would maximize safety. However, the three-component mixture, in its mixed, final form, is still less hazardous to handle than many accepted explosives.
7. The invention herein uses readily available industrial chemical reagents.
8. The composition of the invention has greater explosive properties than the same volume of merely sensitized nitromethane.

Accordingly, it is an object of the present invention to provide a freely pourable, liquid explosive composition which is suitable for commercial use.

A further object of the invention is to create a dense explosive liquid which would provide a great amount of explosive weight in a small volume container.

A further object of the invention is to provide a liquid explosive which does not require the use of any elaborate mixing techniques.

A further object of the invention is to provide a liquid explosive which does not separate upon 24-hours of standing.

Still a further object of the invention is to provide a liquid explosive which is less hazardous to handle than many already accepted explosives.

Other objectives and features of the present invention will be apparent from the following detailed description of the invention and the claims.

DETAILED DESCRIPTION OF INVENTION

The invention herein is a liquid explosive mixture for commercial use. Said mixture is composed of readily available industrial chemicals; and hence, may be easily made and duplicated. The components of the present invention comprise, in specified proportions, nitromethane, trinitrotoluene and pyridine. The form of the trinitrotoluene which may be used in the present invention is not critical. Trinitrotoluene in its flake form, as opposed to its cast form, is preferred since it is more readily soluble. The specified proportions of these components fall within the parameters of about 60–64 parts by weight of nitromethane to about 34–29.5 parts by weight of trinitrotoluene to about 6–6.5 parts by weight pyridine.

The explosive composition of the present invention is easily made. There is no criticality in the method of making said inventive combination. As a matter of fact, no elaborate mixing means, special conditions or apparatus are required to produce the explosive herein. The invention may be prepared using conventional mixing techniques. This makes the explosive of the invention both convenient and relatively simple to make and use.

EXAMPLE I

The amounts of the trinitrotoluene, nitromethane and pyridine are calculated and measured out. The specific amounts of each ingredient used in order to obtain a one liter volume of the explosive are as follows:

nitromethane: 769.2 grams
trinitrotoluene (flake form): 435.9 grams
pyridine: 76.9 grams.

These amounts represent a weight ratio of nitromethane to trinitrotoluene to pyridine of 60:34:6, respectively.

The trinitrotoluene flake is slid into a clean, dry, sealable glass or plastic container. To said container, 680.7 milliliters (equivalent to 769.2 grams) of room temperature nitromethane is poured. The container is then capped to prevent any evaporation of the reactants and to allow gentle agitation of the contents. The mixture will be a tea color. Said mixture is left in the closed container for one hour to facilitate further dissolution of the trinitrotoluene.

If any large amount of trinitrotoluene remains undissolved after the one hour period, a stick may be used to break up the trinitrotoluene remains. Invert the container to allow the trinitrotoluene remains to fall through the nitromethane. The mixture may be stirred gently until the trinitrotoluene is thoroughly dissolved.

The pyridine can be added at this point and can be mixed into solution by either inverting the container or by brief stirring. The final mixture is deep purple in color.

EXAMPLE II

All the steps set forth in Example I, except for the final addition of pyridine, may be duplicated. The addition of the pyridine sensitizer to the trinitrotoluene/nitromethane mixture may be withheld until just prior to the explosive's use. At that time, the pyridine may be added into said solution and mixed in the fashion set forth above.

EXAMPLE III

All the steps set forth in Example I, except for the final addition of pyridine, may be duplicated. The pyridine, however, may be added to the components of the mixture at any time during the mixing process. The addition of pyridine at any point during the mixing process will hasten the dissolution of the trinitrotoluene.

EXAMPLE IV

A test was conducted to observe the detonation power of a liquid explosive within the scope of the invention. The composition of the liquid explosive, which had a volume of 335 ml, contains 64 parts by weight of nitromethane, 29.5 parts by weight of TNT, and 6.5 parts by weight of pyridine. The density of said composition is 1.282 g/ml. The explosive was initiated using three J2 initiators which are commercial copies of the U.S. Army Engineer Special detonator. The detonation of the explosive was conducted in an aluminum can of 6.2 cm ID (inside diameter). The aluminum cans of the type that were used in this test are soft drink cans. The aluminum can containing the explosive was placed standing on a mild steel plate of 1.3 cm thickness. Detonation of the can containing said explosive tore a hole of 5.2 cm diameter in the steel plate. Upon detonation, the bottom of the can was impressed so forcibly upon the steel plate that a 6.2 cm diameter ring was scarred onto the steel plate.

COMPARATIVE EXAMPLE IV

A comparative test was conducted comparing the inventive composition set forth in Example IV with 335 ml (equal volume) of pyridine sensitized nitromethane. The density of said comparative explosive is 1.115 g/ml. The same detonation procedure and materials that were used in Example IV above were repeated herein. The comparative composition, not containing TNT, tore a hole of 3.4 cm diameter in the steel plate. The composition containing pyridine and nitromethane, although effective as an explosive, was not as powerful as compositions containing TNT, pyridine and nitromethane—note a hole torn of 5.2 cm diameter vs. 3.4 cm diameter. This comparative test teaches the presence of TNT as critical to the present invention. Moreover, this comparison varifies that the denser an explosive, the more powerful the detonation is. An increase in density of 15% substantially strengthens the detonation energy of the explosive.

Although the invention has been described with reference to particular embodiments thereof, it should be realized that various changes and modifications may be made therein without departing from the spirit and scope of the invention.

I claim:

1. An explosive composition comprising an effective explosive amount of the combination of (a) nitromethane, (b) trinitrotoluene, and (c) pyridine.

2. The explosive composition according to claim 1, wherein components (a), (b) and (c) have a weight ratio of (a):(b):(c) of about 60–64: 34–29.5: 6–6.5, respectively.

3. The explosive composition according to claims 1 or 2, wherein said explosive composition is in the form of a liquid.

4. The explosive composition according to claim 3, wherein the density of said composition is about 1.282 grams per milliliter.

5. The composition according to claim 2, wherein the composition comprises about 769.2 grams of nitromethane, about 435.9 grams of trinitrotoluene, and about 76.9 grams of pyridine.

6. An explosive composition consisting essentially of an effective explosive amount of the combination of (a) nitromethane, (b) trinitrotoluene, and (c) pyridine.

7. The explosive composition according to claim 6, wherein components (a), (b) and (c) have a weight ratio of (a):(b):(c) of about 60–64: 34–29.5: 6–6.5, respectively.

8. The explosive composition according to claims 6 or 7, wherein said explosive composition is in the form of a liquid.

9. The explosive composition according to claim 8, wherein the density of said composition is about 1.282 grams per milliliter.

10. The composition according to claim 7, wherein the composition comprises about 769.2 grams of nitromethane, about 435.9 grams of trinitrotoluene, and about 76.9 grams of pyridine.

* * * * *